United States Patent [19]

Nussdorfer et al.

[11] Patent Number: 4,550,770

[45] Date of Patent: Nov. 5, 1985

[54] REVERSE CYCLE ROOM AIR CONDITIONER WITH AUXILLIARY HEAT ACTUATED AT LOW AND HIGH OUTDOOR TEMPERATURES

[75] Inventors: William R. Nussdorfer, Greenville; Harry A. Brancheau, Gowen; Steven C. Clark, Grand Rapids, all of Mich.

[73] Assignee: White Consolidated Industries, Inc., Cleveland, Ohio

[21] Appl. No.: 538,943

[22] Filed: Oct. 4, 1983

[51] Int. Cl.[3] ..... F25B 29/00

[52] U.S. Cl. ..... 165/29; 219/279; 62/156

[58] Field of Search ..... 165/29; 219/279; 62/156

[56] References Cited

U.S. PATENT DOCUMENTS

| | | | |
|---|---|---|---|
| 2,847,190 | 8/1958 | Slattery et al. | 257/3 |
| 3,006,613 | 10/1961 | Coyne | 165/29 |
| 3,159,981 | 12/1964 | Huskey | 62/156 |
| 3,167,114 | 1/1965 | Swart, Jr. | 165/29 |
| 3,173,476 | 3/1965 | McCready | 165/29 |
| 3,186,477 | 6/1965 | Bell | 165/29 |
| 3,373,800 | 3/1968 | Ferdelman | 165/29 |
| 3,444,923 | 5/1969 | Kyle et al. | 165/29 |
| 3,537,509 | 11/1970 | Ferdelman | 165/29 |
| 3,799,245 | 3/1974 | Ferdelman | 165/29 |
| 4,024,722 | 5/1977 | McCarty | 62/81 |
| 4,102,391 | 7/1978 | Noland et al. | 165/29 |
| 4,271,899 | 6/1981 | Noland | 165/29 |
| 4,373,350 | 2/1983 | Noland | 165/29 |

*Primary Examiner*—Albert W. Davis, Jr.
*Assistant Examiner*—John K. Ford
*Attorney, Agent, or Firm*—Pearne, Gordon, Sessions, McCoy, Granger & Tilberry

[57] ABSTRACT

A self-contained window-mounted, heat/cool room air conditioner for automatically maintaining a predetermined indoor room temperature over a wide range of outdoor ambient temperatures. The air conditioner includes a reverse cycle refrigeration system having an inside heat exchange coil and an outside heat exchange coil, the coils being series-connected with an associated refrigerant compressor via a reversing valve wherein the system in addition to functioning in a conventional room air cooling mode can also function as a heat pump to heat room air over a limited range of outdoor ambient temperatures. Low and high wattage resistance heating elements supplement or replace the heating action of the reverse cycle refrigeration system under certain operating conditions. Four thermistor temperature sensors are used to provide precise control of the air conditioner for maximum efficiency.

14 Claims, 4 Drawing Figures

REVERSE CYCLE ROOM AIR CONDITIONER WITH AUXILLIARY HEAT ACTUATED AT LOW AND HIGH OUTDOOR TEMPERATURES

BACKGROUND OF THE INVENTION

The present invention relates in general to a self-contained device capable of either heating or cooling an enclosed space to maintain it at a predetermined temperature. In particular, the present invention is directed to a window-mounted room air conditioner of the heat pump type operable to maintain a predetermined indoor room temperature over a wide range of outdoor ambient temperatures.

Self-contained heat pump type room air conditioners are known. U.S. Pat. Nos. 4,102,391; 4,024,722; 3,537,509; 3,373,800; 3,159,981 and 2,847,190 illustrate such prior art devices. Such heat/cool air conditioners include a refrigerant compressor, an indoor heat exchange coil, an outdoor heat exchange coil, and a reversing valve. The compressor, coils, and valve are interconnected in series to provide a conventional reverse cycle refrigeration system.

In a cooling mode of operation, with the reversing valve in a first position, refrigerant circulating in a first direction through the inside coil expands or evaporates to extract heat from the room air, such extracted heat being expelled to the outside ambient air by the outside coil operating as a condenser. In a heating or heat pump mode of operation, with the reversing valve in a second position, refrigerant circulating in a second or reverse direction through the inside coil condenses to provide or give off heat to the room air, such provided heat being extracted from the outside ambient air by the outside coil operating as an evaporator. An indoor fan and an outdoor fan, often rotated by means of a common motor, respectively circulate outdoor ambient air over the outside coil and indoor room air of the inside coil to maximize heat exchange between the coils and outdoor/indoor air.

At low outdoor ambient temperatures (less than 35° F., for example) the ability of the reverse cycle refrigerator system, operating in its heat pump mode to provide heat to the room air, decreases to the point wherein an electrical resistance type heater, located in the path of room air flowing over the inside coil, must be used to replace the heat provided by the reverse cycle refrigeration system which is disabled until the outside ambient temperature rises to a level (e.g., 35° F.) that permits efficient heat pump operation.

A heat/cool room air conditioner of the subject type, as opposed to a larger whole house or central heat pump system, is sold in retail outlets as an owner-installed home appliance. It is well known that the home appliance industry is extremely cost-competitive. Thus, a heat/cool room air conditioner must be produced and sold at a relatively low cost while being efficient from an energy usage standpoint. In designing a heat/cool room air conditioner, care must be taken to provide maximum energy efficiency over the wide range of outdoor ambient temperatures that such heat/cool air conditioner must operate. However, in designing such a system for maximum energy efficiency, manufacturing costs must be kept as low as possible so that the resultant heat/cool air conditioner can be competitively priced at the retail sales level.

SUMMARY OF THE INVENTION

The present invention provides a self-contained room air conditioner for heating or cooling air within a room to maintain a predetermined indoor room temperature over a wide range of outdoor ambient temperatures.

A refrigerant compressor, an inside heat exchange coil, an outside heat exchange coil, and a reversing valve are interconnected to provide a reverse cycle refrigeration system. The refrigeration system is operational in a cooling mode wherein heat is extracted from the room air via the inside coil. In a heat pump mode of operation, heat is provided to the room via the inside coil. The reverse cycle refrigeration system, when operating in its heat pump mode, operates only over a limited range of outdoor ambient temperatures within said wide range of outdoor ambient temperatures.

A heating element means of the electrical resistance type automatically provides heat to the room air when the outdoor ambient temperature is greater than the upper limit of the limited range of outdoor ambient temperatures over which the refrigeration system operates in the heat pump mode.

The heating element means is also operable to automatically provide heat to the room air when the outdoor temperature is less than the lower limit of the limited range of outdoor ambient temperatures over which the refrigeration system operates in the heat pump mode.

Preferably, low and high wattage heating elements constitute the heating means. The low wattage heating element supplements the heating action of the reverse cycle refrigeration system when operating in a lower temperature portion of the limited range of outdoor ambient temperatures over which the refrigeration system operates in the heat pump mode. The low wattage and high wattage heating elements work together to supply heat to the room air when the refrigeration system is not operable as a heat pump due to the outdoor ambient temperature being above or below the lower and upper limits of the temperature range over which the refrigeration system operates as a heat pump. Simultaneous energization of the refrigeration system and the high wattage heating element is precluded by a relay which is capable of energizing either the refrigeration system compressor or the high wattage heating element, but not both simultaneously.

Four independent temperature sensing means are used to optimize control of the heat/cool room air conditioner for maximum efficiency. The temperature sensing means include an outdoor ambient temperature sensing thermistor, an indoor room temperature sensing thermistor, and inside and outside coil temperature sensing thermistors.

A heat/cool room air conditioner in accordance with the present invention provides a relatively low cost device having good energy usage efficiency.

BRIEF DESCRIPTION OF THE DRAWINGS

A fuller understanding of the invention may be had by referring to the following description and claims taken in conjunction with the accompanying drawings, wherein:

DETAILED DESCRIPTION OF THE PREFERRED EMBODIMENT

Figure 1:
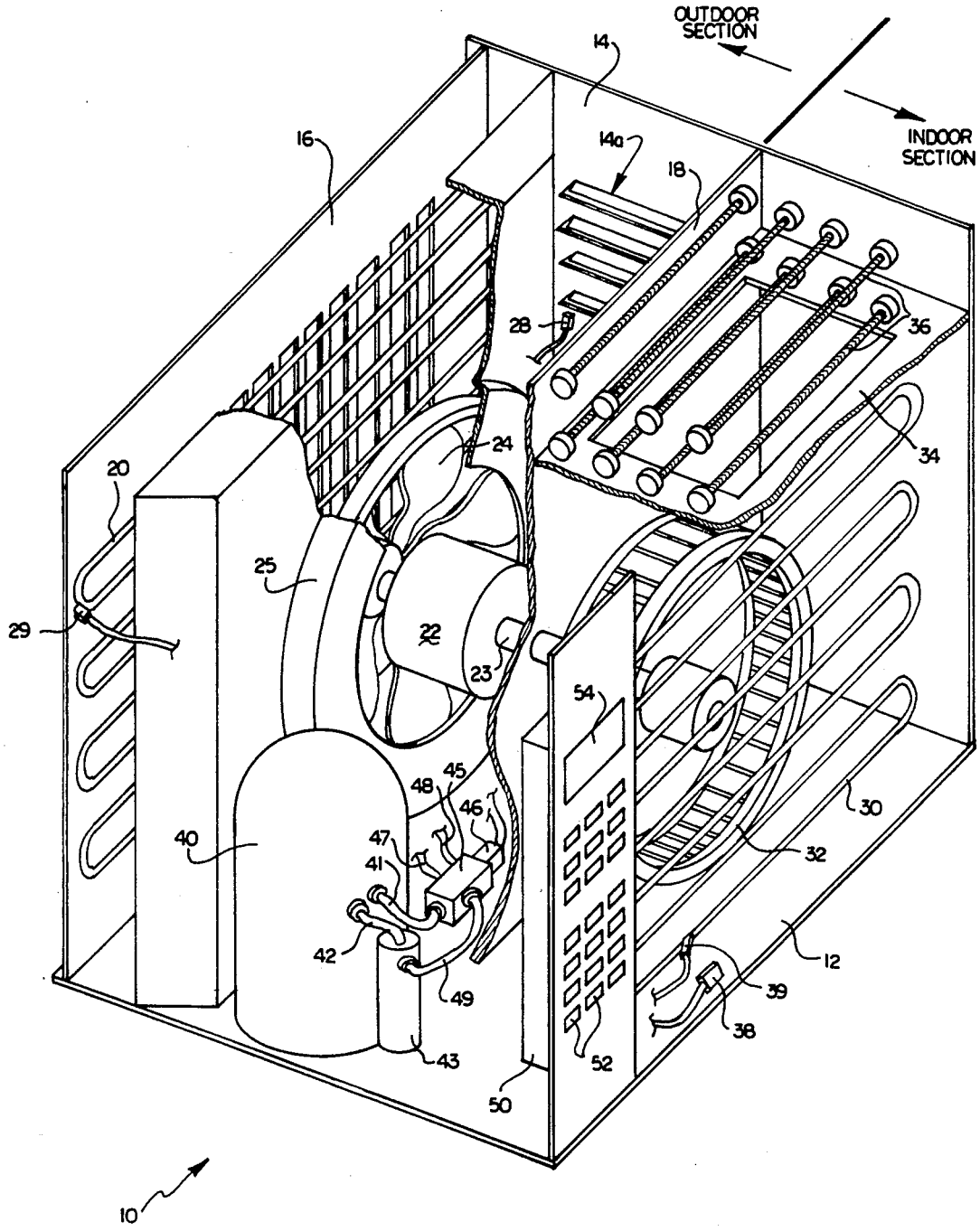
FIG. 1 is a perspective, diagrammatic view of a heat/cool room air conditioner with portions cut away.

FIG. 1 is a diagrammatic illustration of a self-contained heat/cool room air conditioner 10 in accordance with the present invention, the air conditioner 10 being operable to maintain a predetermined indoor room temperature over a wide range of outdoor ambient temperatures. Typically, the boxlike room air conditioner 10 is mountable in a conventional manner through a window opening in the room to be temperature-controlled. It is also possible to mount the air conditioner 10 in a suitable aperture in a room wall that has been specially provided for receipt of a room air conditioner. In its mounted position, the air conditioner 10 is, for the most part, located outside of the room wall, where it is exposed to outdoor ambient temperatures, while an indoor section of the room air conditioner is located within and exposed to indoor room air.

The operating elements of the room air conditioner 10 are contained within a sheet metal-formed housing including a base plate or floor member 12 and a pair of upwardly extending side members or walls 14 (only one shown). An outside ambient air exhaust panel 16, having gatelike apertures to provide air flow therethrough, closes the outdoor end of the boxlike housing. A top cover (not shown) and an inside room air end panel (not shown) complete the boxlike housing containing the operating components of the air conditioner 10. The housing, formed by elements 12, 14, 16, and the top cover (not shown) and inside room air end panel, is divided into the outdoor section and indoor section by a housing dividing wall 18 that, to an extent, thermally isolates the outdoor and indoor sections from each other. As noted earlier, with the air conditioner 10 properly mounted in a window or windowlike aperture in the wall of a room to be temperature-controlled, the indoor section will generally be at indoor room temperature while the outdoor section will generally be at ambient outdoor temperature.

The outdoor section of the room air conditioner 10 contains an outside heat exchange coil 20 of the conventional finned tube conduit type well known in the art. The fins on the tubing of coil 20 have not been illustrated in FIG. 1 so that related portions of the air conditioner could be clearly illustrated. A multispeed, unidirectional fan motor 22 is also mounted within the outdoor section of the room air conditioner 10, the fan motor 22 having a motor shaft that extends from both ends of the fan motor 22, as illustrated. One end of the shaft 23 carries on it a blade-type outdoor ambient air circulating fan 24 located adjacent to the outside heat exchange coil 20. The fan motor 22 rotates the blade-type fan 24 wherein outside ambient air is pulled into the outdoor section of the room air conditioner 10 via an apertured grate portion 14*a* (only one portion shown) of the upwardly extending side walls 14 (only one shown). The outside ambient air drawn into the outdoor section is channeled by a cowling element 25, and forced by the fan 24, through the outside heat exchange coil 20, whereupon it is exhausted outwardly through the apertured outside exhaust panel 16. Thus, it can be seen that the outside ambient air circulated through the outside heat exchange coil 20 either provides heat or extracts heat from such heat exchange coil, depending upon the relative temperatures of the coil 20 and the outside ambient air.

With reference to the indoor section of the room air conditioner 10, an inside heat exchange coil 30, also of the conventional finned tube conduit type (fin elements not shown), is provided adjacent to a squirrel cage blower 32 carried on the other end of the shaft 23 of the fan motor 22. When the squirrel cage blower 32 is rotating, indoor room air is pulled or sucked into the interior of such blower through said indoor heat exchange coil 30, such air then being centrifugally forced out of the blower 32 into a centrifugal blower housing (not shown) wherein the air is circulated via an apertured blower exhaust plate 34, through a heating means such as a plurality of resistance wire heating elements 36, such heated or cooled air then being exhausted into the room to be temperature-controlled. Thus, room air pulled into the indoor section by the rotating centrifugal squirrel cage blower 32 either provides heat to or extracts heat from the inside heat exchange coil 30, such air then being exhausted back into the room after circulating through the resistance wire heating elements 36, which may or may not provide additional heating to the room air, as will be subsequently discussed in greater detail. With reference to both the outdoor section and the indoor section of the room conditioner 10, it can be seen that the motor 22, when rotating, simultaneously rotates the outdoor blade-type fan 24 and the indoor squirrel cage blower 32 to provide outdoor ambient air circulation over the outside heat exchange coil 20 and simultaneous indoor room air circulation over the inside heat exchange coil 30.

The transfer of heat between the outside heat exchange coil 20 and the inside heat exchange coil 30 is accomplished by a reverse cycle refrigeration system which includes a refrigerant compressor in the form of a hermetically sealed, motor-compressor unit 40 of a conventional type. The motor-driven compressor of the hermetically sealed unit 40 provides compressed refrigerant (e.g., Refrigerant-22 $CHClF_2$) to an output conduit 41 which is connected to a reversing valve 45 actuated by an associated reversing valve solenoid 46. The reversing valve 45 provides an inside coil conduit 47 in fluid communication with one end of the inside heat exchange coil 30. The reversing valve 45 also provides an outside coil conduit 48 in fluid communication with one end of the outside heat exchange coil 20. The other ends of the outside and inside heat exchange coils are connected to each other via a refrigerant flow-controlling capillary tube (not illustrated in FIG. 1). Compressed refrigerant provided to the reversing valve 45 via the compressor output conduit 41 is circulated through the series-connected inside and outside heat exchange coils, such circulated refrigerant being directed by the reversing valve 45 to a refrigerant exhaust conduit 49 connected to a conventional accumulator 43 having an output connected to a refrigerant return line 42 of the hermetically sealed motor compressor unit 40.

As will be subsequently illustrated in greater detail, the motor compressor unit 40, the reversing valve 45, the outside heat exchange coil 20, the inside heat exchange coil 30, and the accumulator 43 are connected in series relationship wherein refrigerant can circulate in a first or second direction through such elements to establish a temperature differential between the inside and outside heat exchange coils 20, 30 to provide heating or cooling of the indoor room air.

With further reference to FIG. 1, the indoor section of the room air conditioner 10 includes a conventional air conditioner control module 50, preferably of the solid-state, microprocessor-based type, the module 50 including a plurality of user input touch pads or switches 52. Such switches 52 can be, for example, of the flexible diaphragm type well known in the art, the switches 52 being actuated by the user to program the operation of the air conditioner 10. The module 50 also includes a visual display panel 54 providing visual feedback to the user. In addition to the user inputs provided by the input switches 52, inputs to the control module 50 are also provided by a plurality of temperature sensing means in the preferred form of thermistors. The outdoor section of the room air conditioner 10 includes an outdoor ambient air temperature sensing thermistor 28 and an outside heat exchange coil temperature sensing thermistor 29. It can be seen that the outdoor ambient temperature sensing thermistor 28 is located such that outdoor ambient air entering into the outdoor section of the air conditioner 10 via the grating portion 14*a* of the illustrated sidewall members 14 circulates over and contacts the thermistor 28. It can also be seen that the thermistor 29 is maintained by appropriate means in thermal contact with a portion of the outdoor heat exchange coil 20 so as to monitor its temperature.

In a similar manner, the indoor section of the room air conditioner 10 includes an indoor room air temperature sensing thermistor 38 and an inside coil temperature sensing thermistor 39. The indoor temperature sensing thermistor 38 is located to sense the temperature of the indoor air as it is pulled into the indoor section of the room air conditioner 10 prior to its contact with the inside heat exchange coil 30. The inside coil temperature sensing thermistor 39 is maintained in thermal contact with the inside heat exchange coil 30.

The control module 50 will regulate the operation of the hermetic motor compressor unit 40, the reversing valve 45, the motor 22, and the resistance wire heating element 36, the relative operation of these components being determined by the desired temperature conditions the user wishes to establish. Controlled input parameters to the module 50 include the temperature sensing signals provided by the four thermistors 28, 29, 38, 39 and the desired control inputs fed into the module 50 by the user via the input switches 52.

Figure 2:
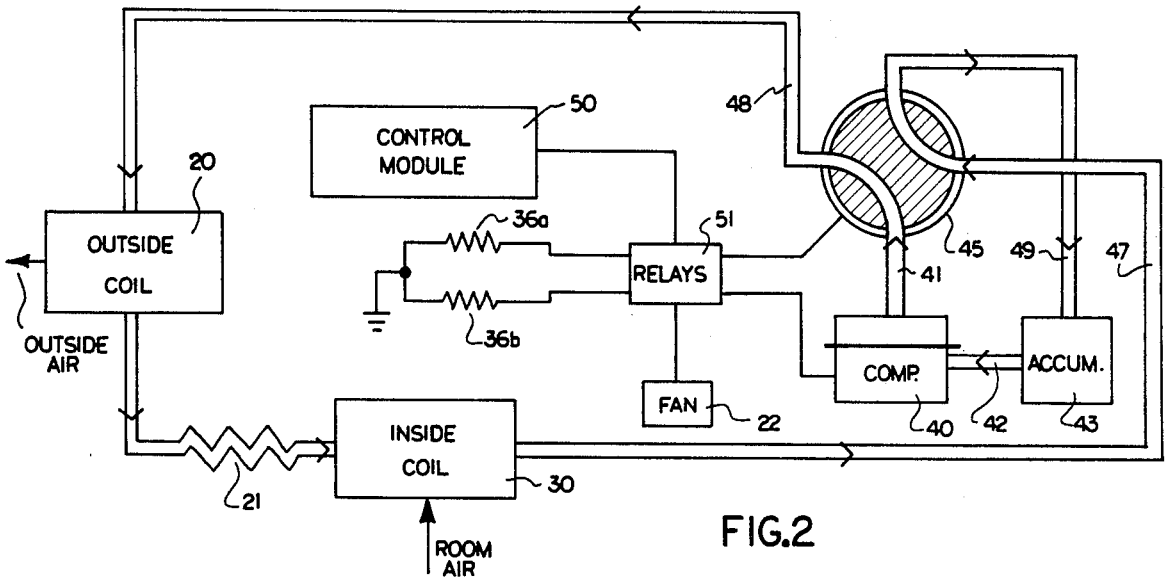
FIG. 2 is a schematic diagram of the reverse cycle refrigeration system forming a portion of the room air conditioner of FIG. 1, the refrigeration system operating in a room/air cooling mode.
Figure 3:
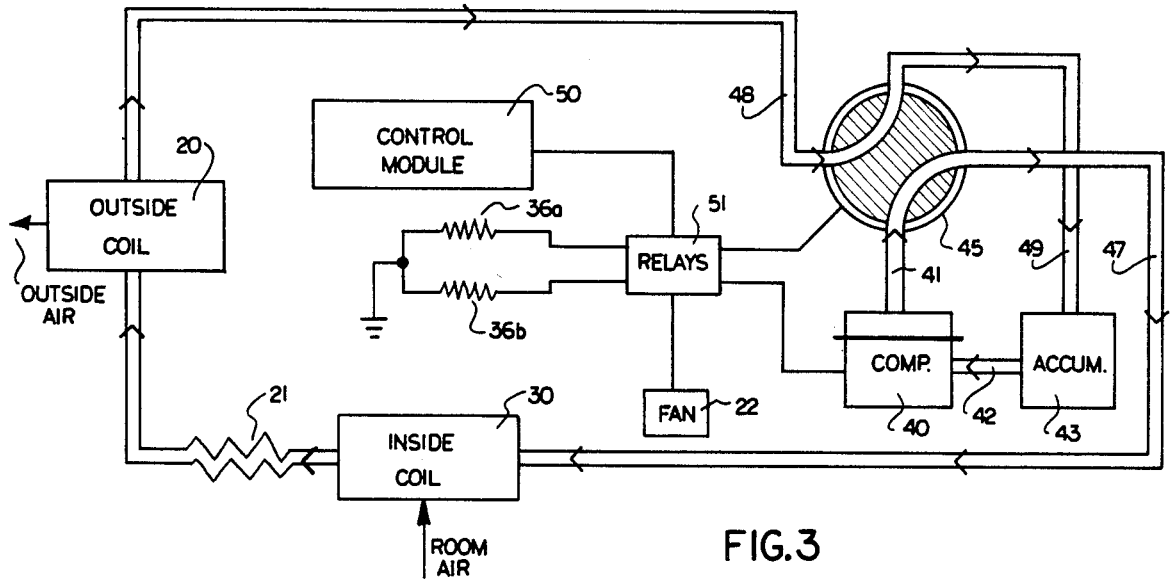
FIG. 3 is a schematic diagram of the reverse cycle refrigeration system forming a portion of the room air conditioner of FIG. 1, the refrigeration system operating in a room/air heating or heat pump mode.

With reference to FIGS. 2 and 3, FIG. 2 illustrates the operation of the room air conditioner illustrated in FIG. 1 in a room air cooling or air conditioning mode, while FIG. 3 represents the room air conditioner of FIG. 1 operating in a room heating or heat pump mode of operation.

With particular reference to FIG. 2, with the reversing valve in its normal or first position (i.e., when the reversing valve solenoid 46—see FIG. 1—is in an unenergized condition), compressed refrigerant provided to the reversing valve 45 via the compressed refrigerant output conduit 41 is provided first to the outside heat exchange coil 20 via the outside coil conduit 48. It is recognized by those skilled in the art that the outside heat exchange coil 20 will be at a higher than outdoor ambient air temperature condition, wherein outside air circulating through the outside exchange coil 20 will extract heat from the refrigerant. The refrigerant, after circulating through the outside heat exchange coil 20, is fed into one end of the refrigerant flow-controlling capillary tube 21 which serves as a metering device to provide the refrigerant in a controlled manner to the inside coil 30, which functions as an evaporator wherein the inside heat exchange coil 30 is at a temperature lower than the indoor room air circulated through it wherein the room air is cooled. The refrigerant, after circulating through the inside heat exchange coil 30, returns via the inside coil conduit 47 to the reversing valve, and then via the exhaust conduit 49 to the accumulator 43 and then to the compressor unit 40 via the compressor return conduit 42. With the room air conditioner operating as described with reference to FIG. 2, the inside room air will be cooled to a predetermined temperature below the outside ambient temperature.

With further reference to FIG. 2, the control module 50 regulates the operation of relay means 51, to be subsequently illustrated, the relay means 51, in turn, controlling the operation of the reversing valve 45, the compressor 40, and the fan motor 22. Also, the resistance wire heater elements 36 (see FIG. 1) are constituted by a low wattage heater section 36*a* and a high wattage heater section 36*b*. When the room air conditioner is in a cooling mode, as illustrated in FIG. 2, the low and high wattage heater sections 36*a* and 36*b* are disabled.

Turning to FIG. 3, the room air conditioner 10 is illustrated as operating in a heating or heat pump mode, i.e., the cycle of operation is reversed from that illustrated in FIG. 2. With the reversing valve in a second condition (i.e., with the solenoid 46 of FIG. 1 energized), the compressed refrigerant provided to the reversing valve 45 via compressed refrigerant output conduit 41 is provided via the inside coil conduit 47, first to the inside heat exchange coil 30 and then, via the capillary tube 21, to the outside heat exchange coil 20, wherein the refrigerant is then returned to the compressor unit 40 via the outside coil conduit 48, the reversing valve 45, the exhaust conduit 49, the accumulator 43, and the compressor return line 42. With the room air conditioner 10 operating in the heat pump mode illustrated in FIG. 3, the inside heat exchange coil 20 will be at a higher temperature than the room air so as to provide heat to it as the room air is circulated over the inside coil 30, as discussed earlier. Concurrently, the outside heat exchange coil 20 will be at a temperature lower than the outside ambient air circulated over it wherein the outside heat exchange coil 30 will extract heat from the outside air and transfer that heat to the inside heat exchange coil. In this mode of operation, the high and low wattage resistance heaters 36*a* and 36*b* under the control of the module 50 may or may not be energized, depending upon certain temperature conditions which will be discussed subsequently in greater detail.

With reference to FIGS. 1, 2, and 3, it can be seen that the air conditioner 10 provided in accordance with the present invention can function to either cool or heat room air over a wide range of outdoor ambient temperatures. When the air conditioner is in a cooling mode of operation, heat is extracted from the room air via the inside coil 30. When the air conditioner is in a heat pump mode of operation, heat is provided to the room air via the inside coil 30 and, in certain situations, by the high and low wattage resistance heaters 36*a*, 36*b*.

In accordance with the present invention, as will be subsequently illustrated, the reverse cycle refrigeration system of the illustrated room air conditioner is operable in its heat pump mode only over a limited range of outdoor ambient temperature which is within a wide range of outdoor ambient temperatures over which the room air conditioner is operable to heat room air. The heating element means 36, comprised of high and low wattage resistance heater elements 36*a* and 36*b*, functions to automatically provide heat to the room air when the outdoor ambient temperature is greater than the upper limit of said limited temperature range or less than the lower limit of said limited temperature range. As will be seen, the operation of the reverse cycle refrigeration system, operating in the heat pump mode, is precluded when the outdoor ambient temperature is at, for example, 70° F. If the user desires to heat the indoor room air to a temperature greater than 70° F., only the resistance heating elements 36*a* and 36*b* are utilized. Such a feature advantageously permits the use of a smaller, lower cost, hermetic motor compressor unit than would be necessary to provide heat pump operation at an outdoor ambient temperature in excess of 70° F.

Figure 4:
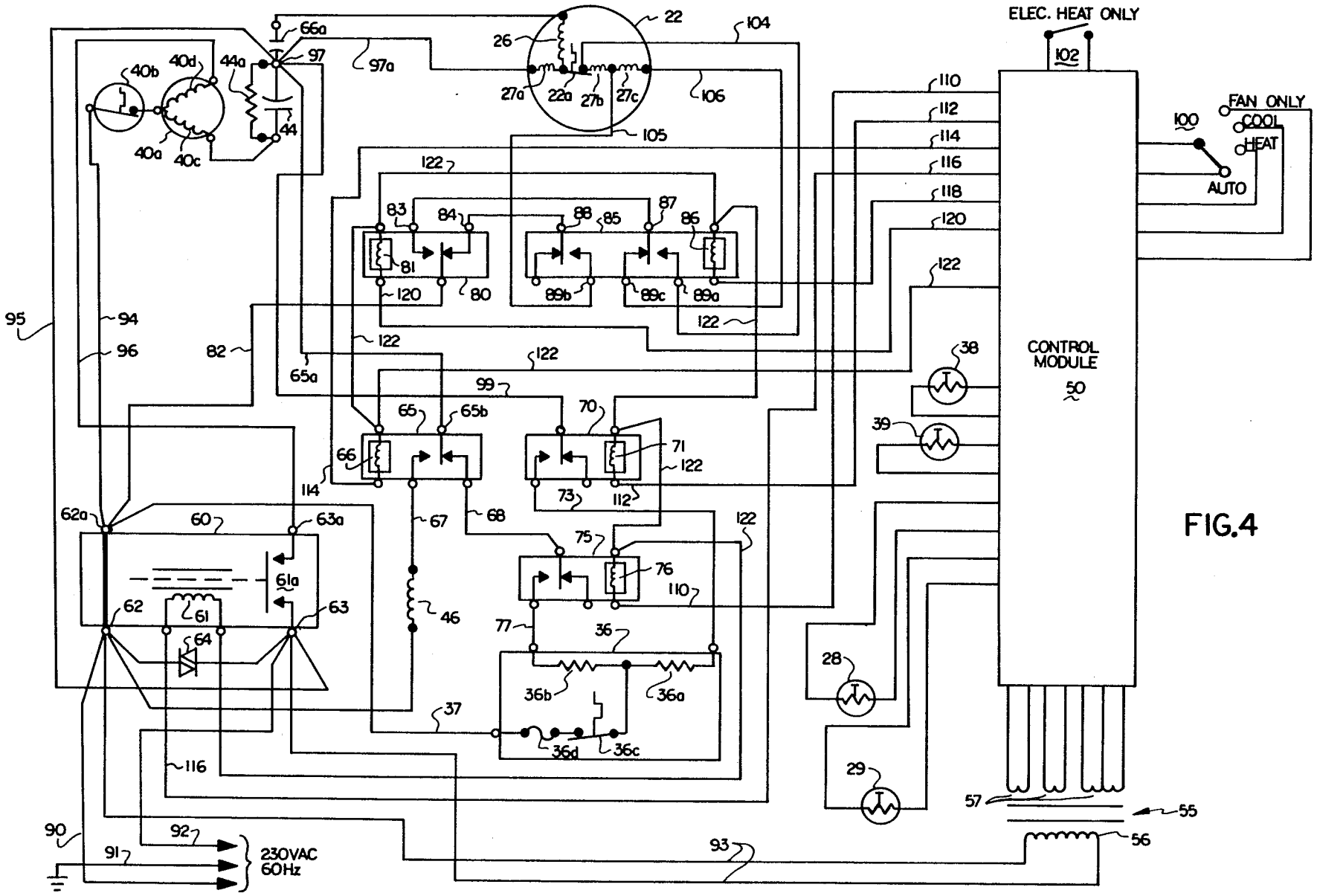
FIG. 4 is a schematic diagram of a control circuit used in regulating the operation of the heat/cool air conditioner illustrated in FIGS. 1 through 3.

A better understanding of the control of the elements comprising the room air conditioner of FIGS. 1–3 can be had by reference to FIG. 4, which is a detailed schematic diagram of the control circuitry and operating components of the heat/cool air conditioner illustrated in FIGS. 1–3.

The multispeed fan motor 22 (in the illustrated form of a three-speed motor) includes a start-winding 26*a*, a high speed run-winding 27*a*, a medium speed run-winding 27*b*, and a slow speed run-winding 27*c*. One end of the start-winding 26 is connected to an end of the high speed run-winding 27*a*, the connected ends of the windings 26*a*, 27*a* being connected to one side of a thermally actuated switch 22*a* (normally closed), whose other side is connected to one end of the medium speed run-winding 27*b*, the other end of the medium speed run-winding 27*b* being connected to an end of the slow speed run-winding, as illustrated. The switch 22*a* protects the motor 22 from overheating by automatically disconnecting the motor from its electrical power supply.

The resistor wire type heater elements 36 (FIG. 1) can be seen to include a low wattage heating element 36*a* and a high wattage heating element 36*b* each having one of their ends connected together and then to one end of a thermally actuated switch 36*c* that will automatically disconnect the heater elements 36*a*, 36*b* from their electrical power source upon occurrence of an overtemperature condition at the site of the heater elements 36*a*, 36*b*. A fuse link 36*d* is connected to the other end of the thermally actuated switch 36*b* as illustrated, and to an electrical power source, as will be further illustrated.

The hermetically sealed motor compressor unit 40, discussed earlier with reference to FIGS. 1 through 3, can be seen to include a compressor driving electric motor 40*a* associated with a conventional thermally actuated switch 40*b* (normall closed) that protects the motor 40*a* from overheating by automatically disconnecting it from its power supply. The motor 40*a* includes a start-winding 40*c* and a run-winding 40*d*, each having one of their ends connected together and then to one side of the thermally actuated switch 40*b*, as illustrated.

The interrelated operation of the compressor driving electric motor 40*a*, the fan motor 22, and the heating elements 36*a*, 36*b* are regulated by the control module 50, which, as noted earlier, can be a microprocessor-based, solid-state circuit responsive to user-inputted program information and to analog temperature sensing inputs provided by the temperature sensing thermistors 28, 29, 38, 39. As will be recognized by those skilled in the art, the control module 50 operates on low control voltages, while the compressor motor 40*a*, the fan motor 22*a*, and the heater means 36 operate at much higher voltages. Interfacing of the low voltage control module 50 to the compressor motor 40*a*, the fan motor 22, and the heater elements 36*a*, 36*b* is accomplished by a plurality of control relays constituting the relay means 51 illustrated in FIGS. 1 and 2.

The control relays include a high current capacity compressor control relay 60 having a low voltage compressor control relay coil 61 that can be energized by the control module 50. The relay coil 61, when energized, will close a set of contacts 61*a* so as to provide power to the compressor motor 40*a* and other portions of the control circuitry, as will be discussed subsequently.

The energization of the solenoid 46 for driving the earlier-discussed reversing valve from its first position (shown in FIG. 2) and second position (shown in FIG. 3) is controlled by a single-pole, double-throw reverse valve control relay 65 having a low voltage reverse valve control relay coil 66 energized by the control modules 50.

A low wattage heater control relay 70, also of the single-pole, double-throw type, having an associated low voltage relay coil 71, regulates the energization of the low wattage heating element 36*a*, while a high wattage heater control relay 75 (single-pole, double-throw type), having a low voltage control relay coil 76, regulates the operation of the high wattage heating element 36*b*. Operation of the multispeed fan motor 22 over the range of its three speeds is regulated by interconnected first and second fan control relays 80, 85 having respective relay coils 81, 86 energized by the control module 50. The first fan control relay 80 is of the single-pole, double-throw type, while the second fan relay is a dual single-pole, double-throw type.

As will now be discussed in greater detail, the control module 50, by regulating the energization of the relay coils 61, 66, 71, 76, 81, and 86, determines the operation of the compressor motor 40*a*, solenoid-actuated reversing valve 45, the heater elements 36*a*, 36*b*, and the fan motor 22.

Input power to the heat/cool air conditioner is provided by a conventional commercial power source supplying, for example, 230 volt alternating current power at a 60 hertz rate. This commercial power is provided on a first high voltage power input line 90, a neutral or ground line 91, and a second high voltage power input line 92 as illustrated. The first high voltage power input line 90 is connected to a first power input terminal 62 of the compressor control relay 60. In a similar manner, the second high voltage power input line 92 is electrically connected to a second power input terminal 63 of the compressor control relay 60. A conventional varistor 64 is connected between the power input terminals 62, 63 to protect the heat/cool air conditioner circuitry from high current and/or high voltage transient spikes that sometimes develop in the commercial power lines providing power to the air conditioner.

With reference to the control module 50, it includes, as a power supply portion thereof, a voltage stepdown transformer 55 having a high voltage primary winding 56 and a plurality of secondary windings 57 supplying suitable operating voltages to the control module 50. The primary winding 56 has its ends connected to the first and second power input terminals 62, 63 of the compressor control relay 60 via a pair of control module power input lines 93. It can be seen that the input power provided on lines 90, 91, 92 is provided to the control module 50 at a reduced voltage via the stepdown transformer 55.

With further reference to the compressor control relay 60, it can be seen that the first power input terminal 62 is electrically connected to one end of the reverse valve actuating solenoid coil 46, having its other end connected to the normally open contact of the reverse valve control relay 65 via a solenoid control line 67. With reference to the second power input terminal 63 of the compressor control relay 60, this terminal 63 is electrically connected to a junction terminal 97 via a power input line 95. The first power input terminal 62 of the compressor control relay 60 is also electrically connected to an associated power output terminal 62*a*, the relay 60 also having an associated second power output terminal 63*a* whose energization is controlled by the set of contacts 61*a* which are normally open until the relay coil 61 is energized. A compressor power return line 94 is connected between the output terminal 62*a* and the junction of the compressor motor start-winding 40*c* and the run-winding 40*d* via the thermally actuated switch 40*b*, as illustrated. The other end of the compressor run-winding 40*d* is connected by a compressor power line 96 to the second terminal 63*a* of the control relay 60. The other end of the start-winding 40*c* is connected to one end of a resistor/capacitor network comprised of a run capacitor 44 paralleled by a high resistance bleeder resistor 44*a*, the network having its other end connected to the junction terminal 97, as illustrated. It can be seen that with the thermal protector switch 40*b* in its illustrated normally closed position (no overheating of the motor 40*a* occurring), voltage will be applied to the start-winding 40*c* via the capacitor 44 and resistor 44*a* at all times, including those times when the set of relay contacts 61*a* are open. With the start-winding 40*c* in a constant state of energization, electrical resistance-generated heat will be provided by the start-winding to the interior of the hermetic shell of the motor compressor unit 40 to ensure minimal heating of the motor compressor unit under low outdoor ambient temperature conditions as required for its operation as a heat pump. This heating action provided by the start-winding is a well-known expedient in the heat pump art. When the relay coil 61 of the compressor control relay 60 is energized by the control module 50, the set of contacts 61*a* will close to connect the run-winding 40*d* to the second power input line 92 via relay 60. Under these conditions, the compressor motor 40*a* will operate the not illustrated compressor of the motor compressor unit 40 so as to provide refrigerant flow to the reversing valve 45 for flow through the inside and outside coils 20, 30 illustrated in FIGS. 1–3.

With reference to the fan motor 22, the end of its start-winding 26 not connected to the end of the high speed run-winding 27*a* is connected, as illustrated, to one end of a fan motor run capacitor 66*a* having its other end connected to the junction terminal 97. The junction terminal 97 is also connected to the free end of the high speed run-winding 27*a*, as illustrated, by a fan power input line 97*a*. The connected ends of the fan start-winding 26 and the high speed fan run-winding 27*a* are connected via the thermally actuated switch 22*a* to a fan high speed control line 104. One end of the fan medium speed run-winding 27*b* is connected to the fan high speed control line 104, while its other end is connected to a fan medium speed control line 105. In a similar fashion, one end of the fan low speed run-winding 27*a* is connected to the control line 105, while its other end is connected to a fan low speed control line 106. The fan high speed control line 104 is connected to a first normally open terminal 89*a* of the second fan control relay 85. The fan medium speed control line 105, in a similar manner, is connected to a second normally open terminal 89*b* of the second fan control relay 85. The fan low speed control line 106 is connected to the normally closed terminal 89*c* associated with the first normally open terminal of the second fan control relay 85.

With reference to the first fan control relay 80, a power input line 82 connected between the common terminal of first fan control relay 80 and the first output power terminal 62*a* of the compressor control relay 60 provides power to either a first power output normally open terminal 82 or a second power output normally closed terminal 84 of the first fan control relay 80. The terminal 83 is connected to a first power input common terminal 87 of the second fan control relay. The second power output terminal 84 of the first fan control relay 80 is connected to a second power input common terminal 88 of the second fan control relay 85.

With reference to the control relay 65, it can be seen that a power line 65*a* connects the junction terminal 97 to the power input common terminal 65*b* of the solenoid control relay 65. Depending upon the energization state of the reverse valve control relay coil 66, power provided at the input terminal 65*b* will in turn be provided to either a solenoid control line 67, connected between the normally open terminal of the relay 65 and the solenoid coil 46, or to a high heat power providing line 68 connected between the normally closed terminal of the relay 65 and the common terminal of the high wattage heater control relay 75. With reference to the low wattage heater control relay 70, power is provided to its common terminal via a low heater relay power line 99 connected directly to junction terminal 97, as illustrated. With reference to the resistance wire heating elements 36*a*, 36*b*, the free end of the low wattage heating element 36*a* is connected to the normally open terminal of the low wattage heater control relay 60 via a low wattage heater power line 73. In a similar fashion, the free end of the high wattage heating element 36*b* is connected to the normally open terminal of the high wattage heater element control relay 75 via a high wattage heater control line 77. As noted earlier, the interconnected ends of the heater elements 36*a*, 36*b* are connected via thermally actuated switch 36*c* and fuse link 36*d* to the first power output terminal 62*a* of the compressor control relay 60 via a heating element common power line 37.

With further reference to the control module 50, a relay power return line 122 (common or ground line) interconnects respective ends of the relay coils 61, 66, 71, 76, 81, and 86, as illustrated. The other ends of such relay coils are connected to respective relay control lines 110, 112, 114, 116, 118, and 120. In particular, a high heat relay control line 110 is connected to the free end of the high heat relay coil 76. A low heat relay control line 112 is connected to the free end of the low heat relay coil 71. In a similar manner, a reversing valve control line 114 is connected to the free end of the reversing valve control relay coil 66. A compressor relay control line 116 is connected to the free end of the compressor control relay coil 61. A first fan relay control line 120 is connected to the free end of the first fan control relay coil 81, while a second fan relay control line 118 is connected to the free end of the second fan control relay coil 86.

Associated with the control module 50 is a mode selector switch 100 having four positions, as illustrated, and an emergency heating switch 102 which, when closed, directly energizes heating elements 36*a*, 36*b* for continuous operation in an emergency situation.

The structure of the heat/cool room air conditioner 10 having been discussed in detail with regard to FIGS. 1–4, typical operations of the heat/cool air conditioner 10 will now be detailed.

With reference to FIG. 4, when the selector switch 100 is in its fan-only position, the fan motor 22 will operate at a predetermined one of its three speeds to circulate indoor room air. When the switch 100 is moved to its cool position, the room air conditioner 10 can only function to cool indoor room air (reversing valve solenoid coil 46 is always de-energized). In a similar manner, when the switch 100 is in its heat position, it can only function to provide heating of the room air (reversing valve solenoid coil always energized when compressor motor 40*a* is running). Finally, with the switch in its auto position, as illustrated in FIG. 4, the heat/cool room air conditioner can cycle between its heating mode and its cooling mode to automatically maintain a predetermined indoor room temperature within a wide range of outdoor ambient temperatures. For example, the wide range of outdoor ambient temperatures can extend from below 0° F. to about 100° F., while maintaining a desired indoor room temperature of, for example, approximately 78° F. In accomplishing automatic temperature regulation of indoor room temperature, control module 50 can function to automatically turn on and off the fan motor 22 at one of its three speeds, turn on and off the compressor motor 40*a*, turn on and off the reverse valve solenoid 46, turn on and off the low wattage resistance heating element 36*a*, and turn on and off the high wattage resistance heating element 36*b*.

The control module 50, by applying an appropriate relay-energizing direct current (D.C.) voltage on control line 110, will energize relay coil 76 so as to apply electric power to the high wattage heating element 36*b* via the solenoid control relay 65 when in its unenergized condition, as illustrated. The flow path of power provided through the high wattage resistance heating element 36 is comprised of lines 92, 95, 65*a*, 68, 77, 37, and 90. In a similar manner, the control module can provide a suitable D.C. voltage on line 112 to energize relay coil 71, wherein power is provided to the low wattage resistance heating element 36*a*. The path of current flow through the low wattage resistance heating element 36*a* is provided via lines 92, 95, 99, 73, 37, and 90.

With reference to control line 114, when the control module 50 applies a suitable D.C. voltage to such control line 114, relay coil 66 is energized to provide current through the reverse valve solenoid coil 46 via lines 92, 95, 65*a*, 67, and 90. It will be recognized that when solenoid 46 is energized, the compressor motor 40*a*, when operating, will cause refrigerant flow through the inside coil and then through the outside coil so that the room air conditioner can provide heat to the room air.

Energization of the compressor motor 40*a* is effected by closing of the set of contacts 61*a*, such closing occurring when the control module 50 applies an appropriate D.C. voltage to line 116, connected to energize the compressor relay coil 61, as illustrated. With the compressor control relay 60 in an energized condition, current will flow through the compressor motor windings 40*c*, 40*d* via lines 90, 92, 95, 96, and 94.

With reference to the fan motor 22, fan relay-engaging D.C. signals applied on lines 118 and 120 by the control module 50 will cause the fan motor 22 to turn on and operate at one of its three speeds. With only relay coil 81 energized via lines 120, the fan motor 22 will operate in a slow speed mode. With only coil 86 energized via control line 118, the fan motor 22 will operate in a medium speed mode. Finally, with both relay coils 81 and 86 energized, the fan motor 22 will operate in a high speed mode.

Thus, it can be seen that the control module 50 regulates the operation of the air conditioning components via control lines 110 through 122.

Specific operating modes of the heat/cool air conditioner in accordance with the present invention will now be discussed. With the selector switch in a fan-only position, the fan motor 22 will operate to circulate room air without any appreciable cooling or heating thereof. In such a fan-only mode, the compressor unit 40 and the heaters 36*a*, 36*b* do not operate. With the selector switch in a cool position, both the fan motor 22 and the compressor motor 49*a* are operational to automatically provide cooling of the room air, it being recognized that in the cooling mode the reverse valve solenoid 46 is not energized. With the selector switch 100 in a heat position, the compressor unit 40 operates in a heat pump mode due to the energization of the solenoid coil 46 of the reverse valve 45. Also, the heaters 36*a*, and 36*b*, can provide heat to the room air in a manner to be subsequently discussed. Finally, with the selector switch 100 in the auto position, the control module 50 can cause the room air conditioner to either heat or cool the room air, such automatic heating or cooling being dependent on the outdoor ambient temperature relative to the desired indoor room temperature. It is to be recognized that the interrelated operation of the compressor unit 40, the reversing valve 45 and its solenoid 46, the fan motor 22, and the heaters 36*a*, 36*b* is determined by the temperature sensing inputs provided by thermistors 28, 29, 30, and 39 and by control parameters inputted to the module 50 by the user.

Primary features of the present invention lie in the utilization of the room air conditioner in its heating mode, such features being more apparent with reference to the following Table:

TABLE A

| | (Heating Mode-Outdoor Temperature) | | |
|---|---|---|---|
| Outdoor Temperature | Comp./Rev. Valve | Low Watt. Heater | High Watt. Heater |
| Less than 35° F. | Non-Oper. | Oper. | Oper. |
| 35° F.–60° F. | Oper. | Oper. | Non-Oper. |
| 60° F.–70° F. | Oper. | Non-Oper. | Non-Oper. |
| Greater than 70° F. | Non-Oper. | Oper. | Oper. |

In accordance with Table A above, and with further reference to FIGS. 1 through 4, the heat/cool air conditioner 10, when in a heating mode, operates in a manner dependent on the outdoor ambient temperature sensed by thermistor 28 (see FIGS. 1 and 4). When the outdoor ambient temperature is less than 35° F., the control module 50, by means of suitable programming, is only operable to energize the fan motor 22 and the lower and high wattage heater elements 36*a*, 36*b* by energization of the control relays 70 and 75, discussed earlier. Thus, heating of the indoor room air to a temperature predetermined by the user relies solely on the resistance heater elements 36*a*, 36*b*. In effect, the reversing valve 45 and compressor 40 are disabled, i.e., the air conditioner cannot operate as a heat pump, since such operation at low outdoor temperatures of less than 75° F. would result in inefficient heat pump operation.

When the outdoor ambient temperature is in the range of 35° F. to 60° F., the compressor unit 40 and reversing valve 45 can be energized by the control module 50 to provide heat pump operation wherein the inside heat exchange coil 30 can provide heat to the room air. In addition, the low wattage resistance heater 36*a* is operational to supplement the heating action of the inside heat exchange coil 30. However, the high wattage heating element 36*b* cannot be energized, due to the reverse valve solenoid actuating SPDT relay 65, which can supply power either to the solenoid coil 46 or to the heater 36*a* via the high wattage heater relay 75, but not to both simultaneously. Such a feature advantageously prevents the simultaneous operation of the high wattage heating element 36*b* and the compressor unit 40 (in its heat pump mode) so as to preclude the generation of high temperatures within the air conditioning unit 10. Thus, it can be seen that the relay 65 functions as means to preclude the simultaneous energization of the reverse cycle refrigeration system of the air conditioner 10 and its high wattage resistance heater element 36*b*.

With further reference to Table A above, when the outdoor ambient temperature is in the range of 60° F. to 70° F., it can be seen that only the compressor and reverse valve are operational so as to function in a heat pump mode. Thus, heating of the indoor room air is provided solely by the inside heat exchange coil, the low wattage and high wattage resistance heater element being non-operational. Finally, when the outdoor ambient temperature is greater than 70° F., the compressor and reversing valve are not operational wherein the room air conditioner 10 cannot operate in a heat pump mode. Heating of the room air is provided solely by the operation of the low and high wattage heater elements 36*a*, 36*b*, and the fan motor. Such a feature, in accordance with the present invention, allows the use of a motor compressor unit 40 sized for efficient operation over the limited temperature range of 35° F. to 70° F. This results in a significant cost savings, since the motor compressor unit does not have to operate as a heat pump at temperatures greater than 70° F. Thus, the air conditioner 10 is operational in its heat pump mode only over the limited outdoor ambient temperature range of 35° F. to 70° F. When the outdoor ambient temperature range is below or above the low and upper limits of said limited temperature range, room air heating is provided solely by the resistance heaters 36*a*, 36*b*.

A further understanding of the operation of the air conditioner 10 in its heating mode may be had with reference to Tables B and C below.

TABLE B

| (Heating Mode-Indoor Temperature Falling) | | |
|---|---|---|
| Temp. Diff. | Comp./Rev. Valve | Low Watt. Heater |
| +2° F. | OFF | OFF |
| −2° F. | ON | OFF |
| −6° F. | ON | ON |

TABLE C

| (Heating Mode-Indoor Temperature Rising) | | |
|---|---|---|
| Temp. Diff. | Comp./Rev. Valve | Low Watt. Heater |
| −6° F. | ON | ON |
| +1° F. | ON | OFF |
| +2° F. | OFF | OFF |

With reference to Table B, when the indoor room temperature is falling, and when the difference between the indoor room temperature sensed by the indoor temperature thermistor 38 is, for example, 2° F. greater than the desired indoor room temperature (e.g., 78° F.), the compressor unit 40 (in a heat pump configuration) and the low wattage heater 36*a* will not operate. This non-operating condition will continue until the sensed indoor room temperature falls 2° below the desired indoor room temperature wherein only the compressor unit 40 will be energized and will operate in the heat pump mode to provide heat to the indoor room air. At this point in time, the low wattage heater 36*a* is not energized. Where the indoor room temperature, in spite of the heating action of the inside heat exchange coil 30, continues to fall to approximately 6° F. below the desired indoor room temperature, the low wattage heater will also be energized to supplement the heating action of the compressor unit 40 operating in a heat pump mode.

With reference to Table C, under an indoor temperature rising condition, it can be seen that only the low wattage heater 36*a* turns off when the measured indoor room temperature exceeds the desired temperature by 1° F. The compressor unit 40 will continue to operate in a heat pump mode until the inside room temperature exceeds the desired indoor room temperature by approximately 2° F.

In comparing Tables B and C, it can be seen that in an indoor temperature falling situation the supplemental heating action of the low wattage heating element is initiated only when a predetermined differential temperature exists between the predetermined indoor temperature and the temperature sensed by the indoor temperature sensing thermistor 38. It can further be seen that, in an indoor temperature rising situation, the supplemental heating action of the low wattage heater element 36*a* terminates when the temperature sensed by the indoor room temperature sensing thermistor increases by a first predetermined amount relative to the desired room temperature. The heating action by the reverse cycle of the refrigeration system continues until the increasing temperature sensed by such temperature sensor changes by a second predetermined amount. Such a feature maximizes the efficiency of the illustrated heat/cool air conditioner, since the more efficient reverse cycle refrigeration system is used as the sole heating means, the use of the low wattage resistance heater 36*a* being used to supplement the heating action of the inside coil only when necessary (i.e., under rapidly falling indoor temperature conditions).

In accordance with the present invention, as exemplifed by Tables A, B, and C, efficient heating of the indoor room air is provided. The motor compressor unit 40, when operating in a heat pump mode, functions over the limited temperture range of 35° F. to 70° F., this limited temperature range being within the wider outdoor ambient temperature range over which the heat/cool room air conditioner 10 is operable to heat room air. When the outdoor ambient temperature is below 35° F. or above 70° F. and heating of the room air is desired, such heating is provided solely by the low and high wattage resistance heating elements 36*a*, 36*b*. When the outdoor temperature is between 60° F. and 70° F. (a lower temperature range portion of the limited temperature range over which the heat pump is operational), the low wattage resistance heating element can supplement the heating action of the inside heat exchange coil 30.

It is to be recognized that the fan motor 22 is speed-regulated by the control module 50 in accordance with predetermined parameters programmed into the module 50. It is also to be recognized that defrosting of the indoor/outdoor coils can be automatically provided. For example, a frost condition sensed by the inside coil thermistor 39 can be eliminated by turning off the motor compressor unit 40 and allowing the fan to circulate warm room air over the inside heat exchange coil 30 until defrosting occurs. Where the outside heat exchange coil becomes frosted during a heat pump mode of operation, as sensed by the outside coil temperature sensing thermistor 29, the fan motor 22 can be turned off and compressor unit 40 can be switched to operate in its cooling mode to extract some heat from the room air, the extracted heat being provided to the outside heat exchange coil for defrosting.

It is to be further recognized that numerous modes of operation of the heat/cool air conditioner can be provided, only a few specific examples directed to the heating mode of operation being illustrated above.

The heat/cool air conditioner 10 in accordance with the present invention, by use of precise temperature control provided by the four temperature thermistors 28, 29, 38, and 39, or by use of the resistance heaters 36*a*, 36*b* to provide heat at both high (75° F. or greater) and low (35° F. or lower) outdoor ambient temperatures, has been found to be energy-efficient. Further, the lower cost of a precisely sized compressor unit for a limited range of heat pump operation only between 35° F. and 70° F. outdoor ambient temperature, allows the air conditioner 10 to be competitively priced.

Although the preferred embodiments of this invention have been shown and described, it should be understood that various modifications and rearrangements of the parts may be resorted to without departing from the scope of the invention as disclosed and claimed herein.

What is claimed is:

1. A self-contained room air conditioner for heating or cooling air within a room to maintain a predetermined indoor room temperature over a wide range of outdoor ambient temperatures comprising:

a refrigerant compressor, an inside heat exchange coil, an outside heat exchange coil, and a reversing valve, said compressor, coils, and valve being interconnected to provide a reverse cycle refrigeration system having a cooling mode of operation wherein heat is extracted from the room air via said inside coil, and having a heat pump mode of operation wherein heat is provided to the room air via said inside coil, said reverse cycle refrigeration system when in said heat pump mode being operable only over a limited range of outdoor ambient temperatures within said wide range of outdoor ambient temperatures; and heating element means of the electrical resistance type for automatically providing heat to said room air when said outdoor ambient temperature is greater than the upper limit of said limited range of outdoor ambient temperatures, and said predetermined indoor room temperature is to be maintained above said outdoor ambient temperature greater than said upper limit.

2. A room air conditioner according to claim 1, wherein said heating element means is operable to automatically provide heat to said room air when said outdoor ambient temperature is less than the lower limit of said limited range of outdoor ambient temperatures, and said predetermined indoor room temperature is to be maintained above said outdoor ambient temperature less than said lower limit.

3. A room air conditioner according to claim 1, wherein said heating element means is operable in a low wattage heating mode and a high wattage heating mode, the heating element in its low wattage heating mode supplementing the heating action of the reverse cycle refrigeration system when operating in its heat pump mode over a predetermined lower temperature portion of said limited range of outdoor ambient temperatures.

4. A self-contained room air conditioner for heating or cooling air within a room to maintain a predetermined indoor room temperature over a wide range of outdoor ambient temperatures comprising:

a refrigerant compressor, an inside heat exchange coil, an outside heat exchange coil, and a reversing valve, said compressor coils and valve being interconnected to provide a reverse cycle refrigeration system having a cooling mode of operation wherein heat is extracted from the room air via said inside coil, and having a heat pump mode of operation wherein heat is provided to the room air via said inside coil, said reverse cycle refrigeration system when in said heat pump mode being operable only over a limited range of outdoor ambient temperatures within said wide range of outdoor ambient temperatures;

a low wattage resistance heater element for automatically providing additional heat to said room air when said reverse cycle refrigeration system is operating in a heat pump mode, and said outdoor ambient temperature is within a lower temperature portion of said limited range of outdoor ambient temperatures; and a high wattage resistance heater element for automatically providing heat to said room air only when said outdoor ambient temperature is above an upper limit or below a lower limit of said limited range of outdoor ambient temperatures, and said predetermined indoor room temperature is to be maintained above the outdoor ambient temperature.

5. A room air conditioner according to claim 4, wherein said low wattage resistance heater element operates simultaneously in conjunction with said high wattage resistance heater element, said heaters simultaneously providing heat to the room air only when said outdoor ambient temperature is above the upper limit or below the lower limit of said limited range of outdoor ambient temperatures, and said predetermined indoor room temperature is to be maintained above the outdoor ambient temperature.

6. A room air conditioner according to claim 4, including means to preclude the simultaneous energization of said reverse cycle refrigeration system and said high wattage resistance heater element.

7. A room air conditioner according to claim 6, wherein said means for precluding is constituted by a relay via which electrical power is provided to said reverse cycle refrigeration system and to said high wattage resistance heater element, said relay including a single-pole, double-throw switch, said switch having a common terminal connected to an electrical power supply, a first power providing terminal connected to the said refrigeration system, and a second power providing terminal connected to the high wattage resistance heater element, said common terminal of said switch being electrically connectable to only one of said power providing terminals at any one time.

8. A self-contained room air conditioner for heating or cooling air within a room to maintain a predetermined indoor room temperature over a wide range of outdoor ambient temperatures comprising:

a refrigerant compressor, an inside heat exchange coil, an outside heat exchange coil, a refrigerant flow controller of the capillary tube type series-connected between the inside coil and the outside coil, and a reversing valve, said compressor coils, controller, and valve being series-interconnected to provide a reverse cycle refrigeration system having a cooling mode of operation wherein heat is extracted from the room air via said inside coil, and having a heat pump mode of operation wherein heat is provided to the room air via said inside coil, said reverse cycle refrigeration system when in said heat pump mode being operable only over a limited range of outdoor ambient temperatures within said wide range of outdoor ambient temperatures, said limited range of outdoor ambient temperatures extending between approximately 35° F. and 70° F.; and heat element means of the electrical resistance type for automatically providing heat to said room air when said outdoor ambient temperature exceeds approximately 70° F., and said predetermined indoor room temperature is to be maintained above said outdoor ambient temperature greater than 70°.

9. A room air conditioner according to claim 8, wherein said heating element means is operable to automatically provide heat to said room air when said outdoor ambient temperature is less than approximately 35° F. and when the predetermined indoor temperature is to be maintained above said outdoor ambient temperature less than 35°.

10. A room air conditioner according to claim 9, wherein said heating element means is operable in a low wattage heating mode and a high wattage heating mode, the heating element in its low wattage heating mode supplementing the heating action of the reverse cycle refrigeration system when operating in its heat pump mode over a predetermined lower temperature portion of said limited range of outdoor ambient temperatures, the range of said lower temperature portion extending between approximately 35° F. and 60° F.

11. A self-contained room air conditioner for heating or cooling air within a room to maintain a predetermined indoor room temperature over a wide range of outdoor ambient temperatures, comprising:

a refrigerant compressor, an inside heat exchange coil, an outside heat exchange coil, and a reversing valve, said compressor, coils and valve being interconnected to provide a reverse cycle refrigeration system having a cooling mode of operation wherein heat is extracted from the room air via said inside coil, and having a heat pump mode of operation wherein heat is provided to the room air via said inside coil, said reverse cycle refrigeration system when in said heat pump mode being operable only over a limited range of outdoor ambient temperatures within said wide range of outdoor ambient temperatures;

a first temperature sensor mounted for sensing the outside ambient temperature;

a second temperature sensor mounted for sensing the indoor room temperature; and a heating element means of the electrical resistance type for automatically providing heat to said room when said outdoor ambient temperature sensed by said first temperature sensor is greater than the upper limit of said limited range of outdoor ambient temperatures, and when said predetermined indoor room temperature is greater than the temperature sensed by said second temperature sensor.

12. A room air conditioner according to claim 11, including a third temperature sensor mounted on said outside heat exchange coil for sensing the outside coil temperature and a fourth temperature sensor mounted on said inside heat exchange coil for sensing the inside coil temperature, said third and fourth temperature sensors indicating a frost/no-frost condition of said outside and inside coils.

13. A room air conditioner according to claim 11, wherein said heating element is operable to supplement the heating action of the reverse cycle refrigeration system, when operating in its heat pump mode over a predetermined lower temperature portion of said limited range of outdoor ambient temperatures, said supplemental heating action by said heating element occurring only if a predetermined differential temperature exists between said predetermined indoor temperature and the temperature sensed by the second temperature sensor.

14. A room air conditioner according to claim 13, wherein said supplementral heating action by said heating element terminates when the temperature sensed by said second temperature sensor changes by a first predetermined amount, said heating action by said reverse cycle refrigeration system continuing until the temperature sensed by said second temperature sensor changes by a second predetermined amount.

* * * * *